United States Patent [19]

Eby

[11] Patent Number: 4,492,377

[45] Date of Patent: Jan. 8, 1985

[54] COLLAPSIBLE BATON

[76] Inventor: George W. Eby, 29188 S. Grayshill Rd., Colton, Oreg. 97017

[21] Appl. No.: 595,353

[22] Filed: Mar. 30, 1984

[51] Int. Cl.[3] ..... F41B 15/02

[52] U.S. Cl. ..... 273/84 R

[58] Field of Search ..... 273/84 R, 84 A

[56] References Cited

U.S. PATENT DOCUMENTS

| | | | |
|---|---|---|---|
| 3,934,877 | 1/1976 | White | 273/84 A |
| 4,007,931 | 2/1977 | Wich et al. | 273/84 A |
| 4,132,408 | 1/1979 | Sabat | 273/84 A |

*Primary Examiner*—William H. Grieb

*Attorney, Agent, or Firm*—Kolisch, Hartwell Dickinson & Anderson

[57] ABSTRACT

A collapsible baton for use by a police or security officer which includes first and second tubular baton sections joined together and biased to an extended position by a biasing collapsible coupler. The coupler includes a first member with a sleeve portion and a second member with a stem portion. The stem portion of the second member conforms with and extends through the sleeve portion of the first member, and is snugly fitted therein. The collapsible coupler further includes an elongate non-extensible connector which extends through the first and second members and is acted upon by a spring means, the spring means and connector cooperating to urge the stem portion into the sleeve portion, thereby aligning the baton sections in an extended position. A strap is provided to retain the baton sections in a folded position when the first and second members are separated and the baton sections are folded over.

9 Claims, 4 Drawing Figures

COLLAPSIBLE BATON

BACKGROUND AND SUMMARY OF THE INVENTION

The instant invention pertains to a collapsible baton. Specifically, the collapsible baton of the instant invention is one which may be folded upon itself, thereby reducing its length by half.

Use of batons by police and security officers is well-known. The traditional baton, or night stick, is a rod-like structure of 18–36 inches in length. Such a baton is an effective and efficient weapon for the foot patrolmen or walking security guard, but is quite cumbersome for the officer assigned to patrol car duty or for a security guard whose post is in a formal indoor location, such as a court room. Furthermore, by reason of court decorum, such batons are sometimes objectionable in court.

An object of the instant invention is to provide a collapsible baton which is foldable upon itself to a stored length.

Another object of the instant invention is to provide a collapsible baton whose pieces are integrally united to each other.

Yet another object of the instant invention is to provide a collapsible baton which may be quickly withdrawn from a holster and deployed to a full length.

Another object of the instant invention is to provide a collapsible baton which is lightweight yet which has a mass suitable for effective and authoritative wielding.

Yet another object of the instant invention is to provide a collapsible baton which may be easily repaired in the event one of its components becomes damaged.

The collapsible baton of the instant invention includes two tubular baton sections of substantially equal length to which are joined together by a biased collapsible coupler. The coupler includes a member which has a sleeve portion and a second member which has a stem portion which is snugly received within the sleeve portion of the first member. The two members are joined together, in a preferred embodiment, by a length of chain, which is biased by a coil spring, such that the first and second members are snugly pulled together. The tubular baton sections are press-fitted onto their corresponding members to complete the baton. A strap is secured to one baton section and may be fastened around the other baton section to hold the collapsed baton in a folded position. When the strap is released, the collapsible coupler causes the sections to rotate relative one another to an extended position bringing the baton to its fully extended and operative length.

These and other objects and advantages of the instant invention will become more fully apparent as the description which follows is read in conjunction with the drawings.

DETAILED DESCRIPTION OF THE PREFERRED EMBODIMENT

Figure 1:
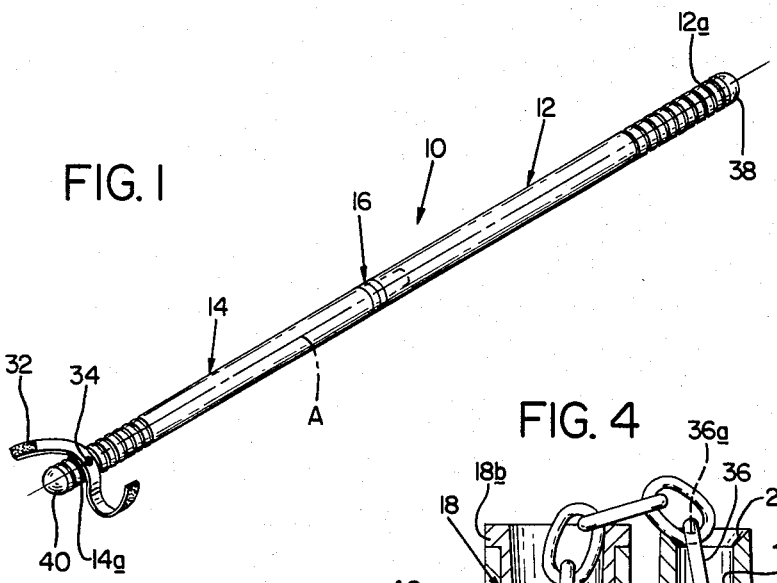
FIG. 1 is a perspective view of a collapsible baton constructed according to the instant invention, in an extended position.

Turning now to the drawings, and initially to FIG. 1, a collapsible baton constructed according to the instant invention is shown generally at 10. Baton 10 includes a first tubular baton section 12 and a second tubular baton section 14. Baton sections 12 and 14 are formed of aluminum tubing and have gripping surfaces, indicated at 12*a* and 14*a*, respectively.

Figure 2:
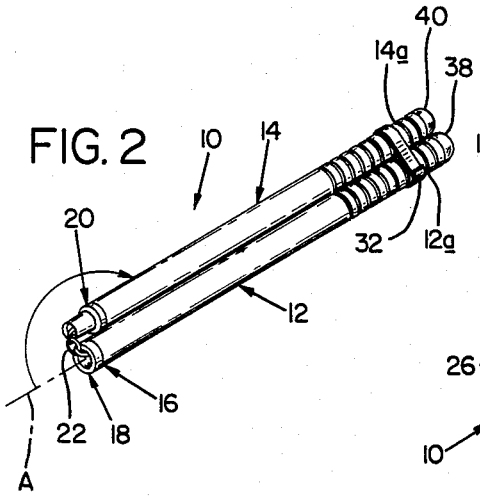
FIG. 2 is a perspective view of the baton in a folded position.

Biased collapsible coupler means 16 is operatively interposed baton sections 12 and 14. Coupler means 16 allows sections 12 and 14 to be selectively axially aligned along an axis A, and misaligned as the collapsible baton is shifted from an extended position, shown in FIG. 1 to a folded position, which is shown in FIG. 2.

Figure 4:
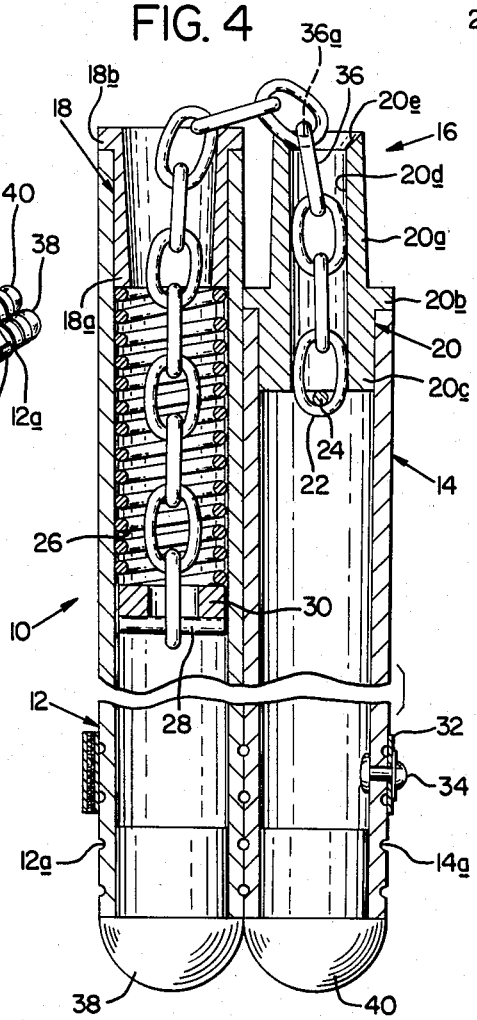
FIG. 4 is a median sectional view similar to FIG. 3 with the baton in a folded position.
Figure 3:
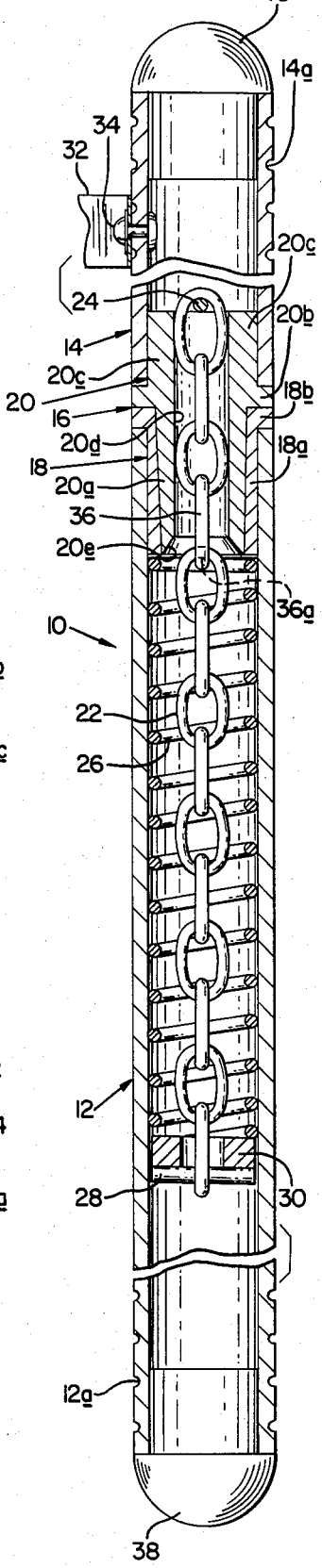
FIG. 3 is a median sectional view showing a biased collapsible coupler means of the invention with the collapsible baton in an extended position.

Moving now to FIGS. 3 and 4, the components of the biased collapsible coupler means are shown in greater detail. Coupler means 16 includes a first member 18 which includes a sleeve portion 18*a* and an annular radially outward projecting shoulder 18*b*. Baton section 12 is snugly press-fit on member 18, with member 18 fixedly engaging section 12 adjacent shoulder 18*b*.

A second member 20 includes a stem portion 20*a* which conforms with and extends through sleeve portion 18*a*. The outer surface of stem 20*a* is tapered to conform with the inner tapered surface of sleeve portion 18*a*. Additionally, member 20 has an annular radially outwardly projecting shoulder 20*b*. A mounting portion 20*c* forms the end of member 20 opposite stem portion 20*a*. Baton section 14 is snugly press-fitted on mounting portion 20*c*, with an end of section 14 terminating adjacent shoulder 20*b*. A passage 20*d* extends through the second member between its ends. Passage 20*d* in the preferred embodiment, is cylindrical with a diameter of approximately ½ inch. The passage expands, at the end of stem portion 20*a*, with a beveled margin 20*e*.

The coupler means further includes biasing means which acts to pull the first and second members together with stem portion 20*a* being drawn into sleeve portion 18*a*, thereby aligning baton sections 12 and 14 along axis A, as shown in FIG. 1. Biasing means in the preferred embodiment is an elongate yieldably resilient assembly which includes an elongate non-extensible connector, which referring again to FIGS. 3 and 4, takes the form of a chain 22. Chain 22, in the preferred embodiment, is a straight link machine chain, size 4. Each end of the chain is secured by a retainer. One end of the chain is anchored adjacent second member 20's other end by retainer pin 24.

A coil spring 26, also referred to herein as spring means, is interposed an end of first member 18 and another retainer pin 28. A washer 30, serves as a contact plate between spring 26 and pin 28.

In FIG. 3, the baton 10 is shown in its extended position. In this position, spring 26 is extended to its longest length. Viewing the baton in its folded position, as shown in FIG. 4, spring 26 is compressed to its shortest length. It is apparent that were some force not used to hold the baton sections in the folded position shown in FIGS. 2 and 4, the biased collapsible coupler means would urge the baton towards its extended, full length, position. Strap 32 is provided to hold baton in its folded, stored length, position. The strap is secured to one of the baton sections, section 14 in this instance, by a fastener, such as rivet 34. The strap in the preferred embodiment has mating Velcro ends which secure the ends of the strap to each other, thereby holding the baton in its folded position. The baton is normally carried in a side holster. The baton may be quickly deployed by removing it from the holster, undoing the strap and allowing the biasing means to cause the baton sections to align along axis A.

An important feature of the invention is the use of chain which is sized such that stem portion 28*a* terminates in its beveled margin 20*e* coincidentally with an inner edge of a link, such as the link shown at 36 with inner edge 36*a*. This precise location of a link inner edge allows the chain to pivot with very little friction between members 18 and 20 when the members are separated and the baton folded. Thus, an important advantage is attained by using straight link chain as opposed to a non-extensible cable or shock-cord, although such material may be used as a non-extensible connector. The pivoting allowed by the use of chain of exact size significantly reduces the wear which one might expect to occur between the connector and the beveled margin of stem 20*a*.

The baton sections have hard rubber or metal plugs, such as those shown at 38 and 40 in the ends of the tubular sections distal from coupler means 16. The plug provides a smooth end to the deployed baton, which may be used to exert authoritative, but essentially non-lethal, force with the ends of the baton, battering ram style.

An important feature of the baton is the ability to replace an individual baton section, should such a section become damaged while the baton is in use. Sections 12 and 14, as previously mentioned, are press-fitted onto members 18 and 20. Since the coupler means may exist intact without the baton sections fitted thereto, it is apparent that the baton sections may be easily removed and replaced with a minimum amount of time and equipment, thereby providing a "new" baton in place of an old, damaged baton.

Although a preferred embodiment of the invention has been described, it should be appreciated that variations and modifications may be made without departing from the spirit of the invention.

It is claimed and desired to secure by Letters Patent:

1. A collapsible baton comprising a first member including a sleeve portion and an annular radially outwardly projecting shoulder joined to one end of the sleeve portion, a second member including a stem portion conforming with and extending through said one end of the sleeve portion and snugly fitted within said sleeve portion, said second member further including a mounting portion forming the other end of the second member and an annular radially outwardly projecting shoulder disposed intermediate said stem portion and said mounting portion, said second member having a passage extending therethrough between its ends, a first tubular baton section with one end enveloping and fixedly engaging the sleeve portion of said first member adjacent the shoulder of said first member, a second tubular baton section with one end enveloping and fixedly engaging said other end of said second member adjacent its shoulder, and biasing means operatively interposed the two members operatively to pull them together.

2. The collapsible baton of claim 1, wherein said biasing means comprises an elongate yieldably resilient assembly with one end mounted on and supported by said first member and an opposite end mounted on and supported by said second member.

3. The collapsible baton of claim 1, wherein said biasing means includes an elongate non-extensible connector extending through said sleeve portion of said first member and said passage of said second member, a retainer mounted on each end of said connector for anchoring the end of the connector and a spring means interposed at least one of said members and a retainer mounted on one end of said connector.

4. The collapsible baton of claim 3, wherein said connector is a chain, one end of the chain is anchored by a retainer against the opposite end of the second member, and said spring means is interposed said first member and the retainer mounted on the chain's other end.

5. A collapsible baton comprising, a first tubular baton section, a second tubular baton section, biased collapsible coupler means operatively interposed said first and second baton sections for selectively axially aligning and misaligning the two sections, said coupler means including a first member including a sleeve portion and an annular radially outwardly projecting shoulder joined to one end of the sleeve portion, said sleeve portion fixedly engaging said first tubular baton section adjacent said shoulder, a second member including a stem portion at one end conforming with and extending into said sleeve portion and snugly fitted within said sleeve portion, said second member further including a mounting portion forming the other end of the second member and an annular radially outwardly projecting shoulder disposed intermediate said stem portion and said mounting portion, said second member having a passage extending therethrough between its ends, said second member fixedly engaging said second baton section with said mounting portion, said second baton section terminating adjacent the shoulder of said second member, an elongate non-extensible connector extending intermediate its ends through said sleeve portion and said passage, a retainer mounted on and anchoring one end of the connector adjacent said second member's other end, a retainer mounted on the other end of the connector, and spring means interposed said first member and the second-mentioned retainer, said spring means and said connector coacting to operatively pull the two members together.

6. The collapsible baton of claim 5 wherein said connector is a chain having straight links.

7. The collapsible baton of claim 6 wherein said chain links and said second member are sized such that said second member's stem portion terminates coincidentally with an inner edge of a link which has a majority of its length within said passage.

8. A collapsible baton comprising a first tubular baton section, a second tubular baton section, biasing collapsible coupler means for axially joining and separating said first and said second tubular baton sections, said coupler means including a first member including a sleeve portion and an annular radially outwardly projecting shoulder joined to one end of the sleeve portion, said sleeve portion fixedly engaging said first tubular baton section adjacent said shoulder, a second member including a stem portion at one end conforming with and extending into said sleeve portion and snugly fitted within said sleeve portion, said second member further including a mounting portion forming the other end of the second member and an annular radially outwardly projecting shoulder disposed intermediate said stem portion and said mounting portion, said second member having a passage extending therethrough between its ends, said second member fixedly engaging said second baton section with said mounting portion, said second baton section terminating adjacent the shoulder of said second member, an elongate non-extensible chain extending intermediate its ends through said sleeve portion and said passage, a retainer mounted on and anchoring one end of said chain adjacent said second member's other end, a retainer mounted in the other end of said chain, and spring means interposed said first member and the second-mentioned retainer, said spring means and said chain coacting to operatively pull the two members together.

9. The collapsible baton of claim 8 wherein said chain links and said second member are sized such that said second member's stem portion terminates coincidentally with an inner edge of a link which has a majority of its length within said passage.

* * * * *